US007234330B2

(12) United States Patent
Tseng

(10) Patent No.: US 7,234,330 B2
(45) Date of Patent: Jun. 26, 2007

(54) LOCK WITH AN IMPROVED CONFIGURATION

(75) Inventor: Bao Hsin Tseng, Sinjhuang (TW)

(73) Assignee: Camlock Systems, Ltd, Easbourne, East Sussex (GB)

( * ) Notice: Subject to any disclaimer, the term of this patent is extended or adjusted under 35 U.S.C. 154(b) by 0 days.

(21) Appl. No.: 11/130,475

(22) Filed: May 17, 2005

(65) Prior Publication Data

US 2005/0257584 A1 Nov. 24, 2005

(30) Foreign Application Priority Data

May 19, 2004 (TW) ..... 93207835 U

(51) Int. Cl.
*E05B 27/00* (2006.01)

(52) U.S. Cl. ..... 70/491; 70/375; 70/378; 70/419

(58) Field of Classification Search ..... 70/491, 70/493, 376, 378, 403–404, 454, 453, DIG. 37, 70/358, 31, 427, 374, 450, 449, 402, 407, 70/DIG. 13, 367, 373, 375, 490–492, 381–385, 70/416, 419, 417–418
See application file for complete search history.

(56) References Cited

U.S. PATENT DOCUMENTS 406,648 A * 7/1889 Hope, Jr. ..... 70/223
3,903,720 A * 9/1975 Scherbing ..... 70/491
4,233,828 A * 11/1980 Dauenbaugh ..... 70/491
4,674,306 A * 6/1987 Halpern ..... 70/233
6,038,898 A * 3/2000 Cliff ..... 70/491
6,357,271 B1 * 3/2002 Hsu ..... 70/491
D472,434 S * 4/2003 Trempala ..... D8/21
6,550,299 B1 * 4/2003 Lin ..... 70/491
6,644,078 B1 11/2003 Hung

FOREIGN PATENT DOCUMENTS

EP 0936330 8/1999
JP 2004 324141 11/2004

* cited by examiner

*Primary Examiner*—Suzanne Dino Barrett
*Assistant Examiner*—Christopher Boswell
(74) *Attorney, Agent, or Firm*—Keeling Patents and Trademarks, LLC; Kenneth A. Keeling

(57) ABSTRACT

A lock with an improved configuration comprises a housing and a cylindrical member mounted in the housing. A lock core is mounted in the cylindrical member. The lock is characterized in that the cylindrical member comprises either nine or eleven pin recesses at the front end, a disc and an engaging post having a dodecagonal section are mounted at the front end of the lock core, and the disc comprises nine through passages and three openings of different depths. Based on the configuration of the lock, the key to be inserted into the lock must have a dodecagonal inner passage to match the dodecagonal section of the engaging post of the lock. Because of the three openings of different depths, a thief cannot use specialized tools to explore the lock and unlock the lock. The number of codes of the lock is increased to keep the lock from being easily unlocked. The owner's property and privacy of are thus protected.

4 Claims, 2 Drawing Sheets

LOCK WITH AN IMPROVED CONFIGURATION

CROSS-REFERENCE TO RELATED APPLICATIONS

This application claims priority to Taiwan Patent Application No. 93207835, filed May 19, 2004.

STATEMENT REGARDING FEDERALLY SPONSORED RESEARCH OR DEVELOPMENT

Not Applicable.

SEQUENCE LISTING

Not Applicable.

BACKGROUND OF THE INVENTION

This invention relates to a lock having an improved configuration, in particular to a lock to prevent the lock from being easily unlocked to protect an owner's property and privacy.

BRIEF SUMMARY OF THE INVENTION

A lock known in the art is configured to comprise a lock core. A matching key can be inserted into the lock and rotated to unlock the lock. Therefore, the lock core is an "identifier" to determine whether or not the person trying to unlock the locked device is authorized access and may be regarded as the "heart" of the lock. The mechanism of the lock is designed to open the lock only by using a matching key. Thus, a basic function of the lock is to keep the lock from being unlocked by various other tools.

However, as shown in FIG. 4, one disadvantage of the conventional lock 100 is on the lock core. Since the engaging rod 101 in the locking channel is cylindrical, any key 102 of the same type can be inserted into the lock. The code of the lock can only be changed in the cylindrical space in the lock, and the number codes is not large so the lock can be easily unlocked with another key. Moreover, a thief can easily pick the lock and overcome the code of the lock with a specialized tool. A lock with such a conventional design is not adequate to protect an owner's property and privacy.

In light of foregoing disadvantage of the conventional lock, the inventor of the present application had made an effort to design a novel lock having an improved configuration.

The primary object of this invention is to provide a lock with excellent security and prevent the lock from being damaged.

To achieve the foregoing objective, the lock with an improved configuration in accordance with the present application comprises a housing with a cylindrical member arranged in the housing. A lock core can be mounted in the cylindrical member. The lock is characterized in that the cylindrical member comprises nine or eleven recesses at the front end, a disc and an engaging post having a dodecagonal section, which are mounted at the front end of the lock core, and the disc has nine through passages and three openings of different depths.

Based on the forgoing configuration, a key to be inserted into the lock must have a dodecagonal inner passage to match the dodecagonal section of the engaging post of the lock. Because of the openings of different depths, a thief cannot explore and pick the lock with specialized tools, and the number of codes of the lock is increased to keep the lock from being easily unlocked. The owner's property and privacy are thus protected.

DETAILED DESCRIPTION OF THE INVENTION

Various aspects of the present invention are discussed and described in detail below with reference to a preferred embodiment and the accompanying drawings.

Figure 1:
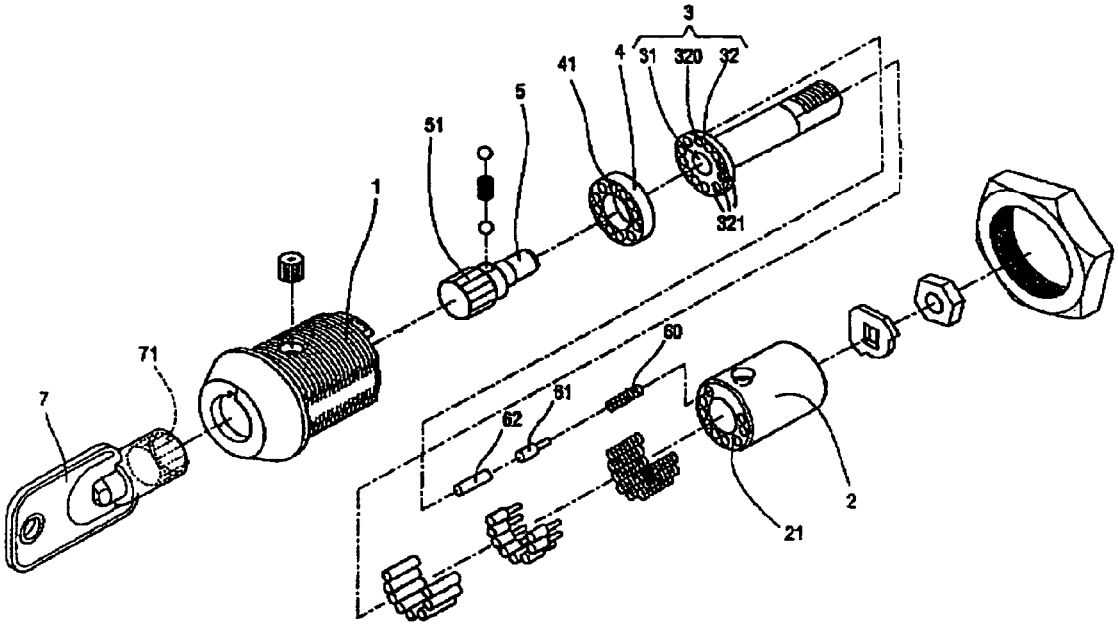
FIG. 1 is an exploded perspective view of the lock in accordance with the present invention.
Figure 2:
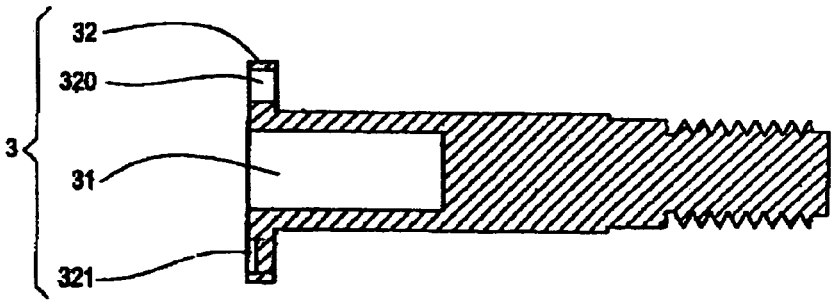
FIG. 2 is a cross sectional view of the lock core in accordance with the present invention.

With the reference to FIGS. 1 and 2, the lock with an improved configuration in accordance with the present application comprises a housing 1 and a cylindrical member 2 arranged in the housing 1. A lock core 3 can be mounted in the cylindrical member 2. The lock core 3 has a passage 31 at the front end, and an inserting pin 5 can be inserted into the passage 31. A disc 32 is attached to the lock core 3 at the front end of the passage 31. A ring 4 is placed between the disc 32 and the inserting pin 5.

The lock is characterized in that the cylindrical member 2 comprises nine or eleven pin recesses 21 at the front end. Each of the pin recesses 21 has a spring 60 mounted in the pin recess 21. Each of the springs 60 has a pushing element 61 mounted at the front end of the spring. The disc 32 comprises through passages 320 corresponding to the pushing elements 61 and either one or three openings 321 of different depths in the surface of the disc. The ring 4 has twelve positioning passages 41 with positioning posts 62 of different lengths mounted in the positioning passages 41. The positioning posts 62 can protrude out of the positioning passages 41 by being pushed by the pushing elements 61 and the springs 60. An engaging post 51 having a dodecagonal section is positioned at the front end of the inserting pin 5.

Figure 3:
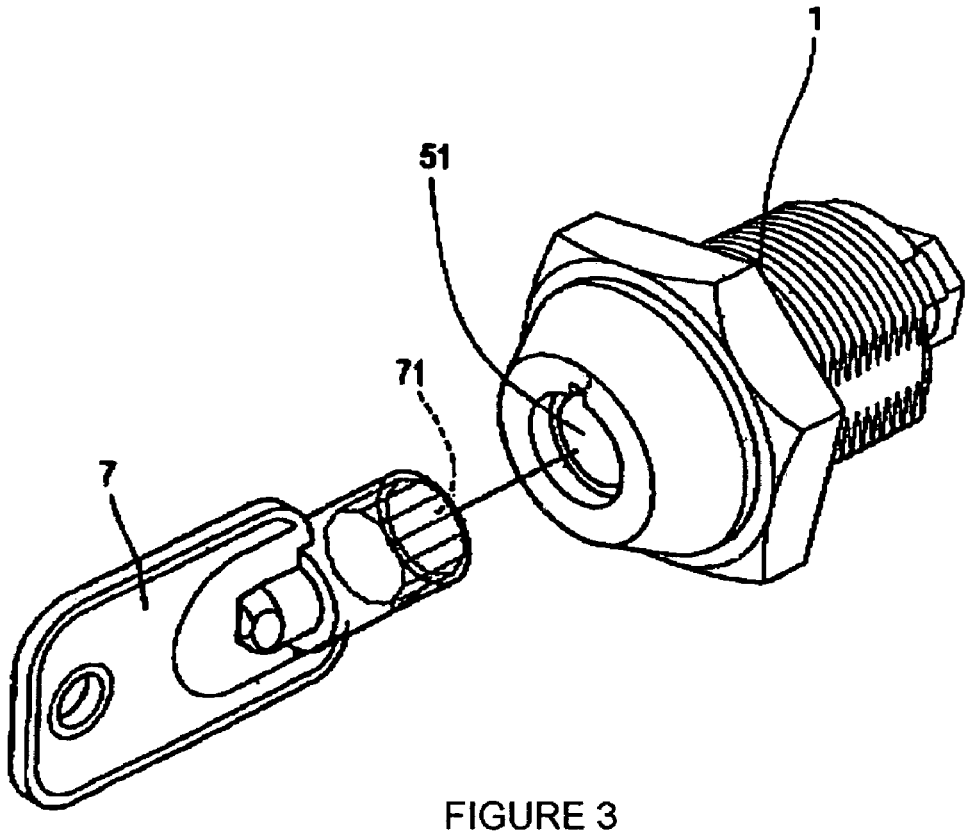
FIG. 3 is a perspective view of the lock in accordance with the present invention and a matching key for the lock.
Figure 4:
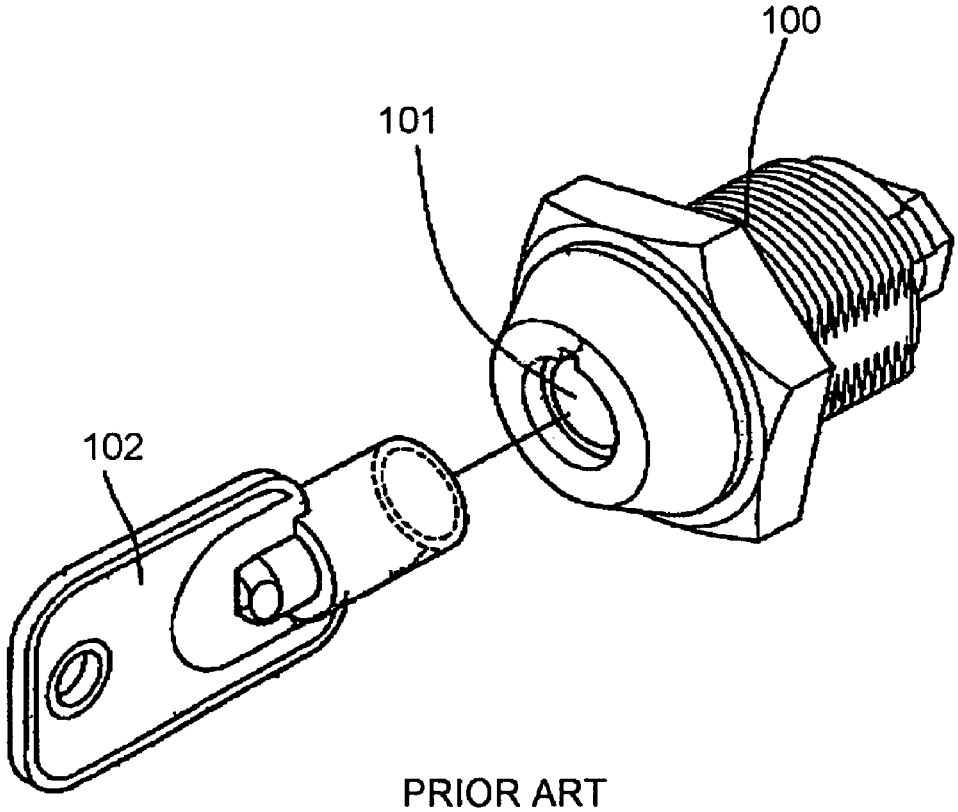
PRIOR ART FIGURE 4
FIG. 4 is a perspective view of a conventional lock and a matching key for the lock.

With reference to FIG. 3, the key 7 to be inserted into the lock of this invention must have a dodecagonal inner passage to be inserted into the space between the housing 1 and the engaging post 51. The positioning elements, pushing elements and springs are pushed into proper position by the key 7, so that a plane formed by the contact points of the positioning posts and the pushing elements align with the front face of the cylindrical member. In this way, the lock core can be rotated by the key to unlock the lock.

From the forgoing description, a conventional key having a circular inner passage cannot be inserted into the lock of this invention. As such, the arrangement of the positioning posts in the lock will not easily be found and thus the lock cannot be easily unlocked by another person. The owner's property and privacy are thus protected.

Further, an unauthorized person cannot use specialized tools to probe and find the depths of the pin recesses and the length of each of the positioning post since the disc has either three openings of distinguishable depths or one opening. The lock in accordance with this invention provides more combinations for the lock. A skilled thief can find no way to pick or unlock the lock in accordance with this invention.

In summary, the lock having an improved configuration in accordance with this invention can certainly keep the lock from being picked or unlocked easily. The owner's property and privacy are thus protected. Therefore, the present invention is industrially applicable and non-obvious.

I claim:

1. A lock comprising:

a housing and a cylindrical member, said cylindrical member located within said housing, a lock core located within said cylindrical member, said lock core having a passage at a lock core front end;

an inserting pin, said passage sized to receive said inserting pin therethrough;

said lock core attached to a disc proximate a passage front end;

an engaging post attached at a front end of said inserting pin;

a ring mounted intermediate said disc and said engaging post;

said cylindrical member having nine pin recesses at a cylindrical member front end;

a spring mounted proximate each of said nine pin recesses;

a pushing element mounted at a front end of each said spring;

said disc having nine disc through passages, each said disc through passage alignable with one of said nine pin recesses;

said disc having three front openings at a disc front face, each of said three front openings having a different depth from said disc front face than the other two of said three front openings;

said ring having twelve positioning passages, each of said twelve positioning passages aligned with a disc through passage or a disc front opening; and positioning posts of varying lengths mounted in said twelve positioning passages, the front openings receiving no positioning posts and no pins.

2. The lock of claim 1, wherein said engaging post bas a dodecagonal exterior surface at a front end of said engaging post.

3. A lock comprising;

a housing and a cylindrical member, said cylindrical member located within said housing;

a lock core located within said cylindrical member, said lock core having a passage at a lock core front end;

an inserting pin, said passage sized to receive said inserting pin therethrough;

said lock core attached to a disc proximate a passage front end;

an engaging post attached at a front end of said inserting pin;

a ring mounted intermediate said disc and said engaging post;

said cylindrical member having eleven pin recesses at a cylindrical member front end;

a spring mounted proximate each of said eleven pin recesses;

a pushing element mounted at a front end of each said spring;

said disc having eleven disc through passages, each said disc through passage alignable with one of said eleven pin recesses;

said disc having a front opening at a disc front face;

said ring having twelve positioning passages, each of said twelve positioning passages aligned with a disc through passage or the disc front opening; and positioning posts of varying lengths mounted in said twelve positioning passages; the front opening receiving no positioning posts and no pins.

4. The lock of claim 3, wherein said engaging post has a dodecagonal exterior surface at a front end of said engaging post.

* * * * *